US008763168B2

(12) United States Patent
Zhou

(10) Patent No.: US 8,763,168 B2
(45) Date of Patent: Jul. 1, 2014

(54) HINGE ASSEMBLY FOR TOILET SEAT

(75) Inventor: Wenhui Zhou, Zhongshan (CN)

(73) Assignee: Zhongshan Meitu Plastic Ind. Co., Ltd., Zhongshan, Guangdong (CN)

( * ) Notice: Subject to any disclaimer, the term of this patent is extended or adjusted under 35 U.S.C. 154(b) by 755 days.

(21) Appl. No.: 12/984,787

(22) Filed: Jan. 5, 2011

(65) Prior Publication Data

US 2012/0167291 A1 Jul. 5, 2012

(51) Int. Cl.
*A47K 13/12* (2006.01)

(52) U.S. Cl.
USPC ..... 4/236

(58) Field of Classification Search
USPC ..... 4/234–231
See application file for complete search history.

(56) References Cited

U.S. PATENT DOCUMENTS 4,391,001 A * 7/1983 Harrison ..... 4/236
4,398,307 A * 8/1983 Ginsburg et al. ..... 4/236
4,514,356 A * 4/1985 Harrison ..... 264/328.12
4,965,889 A * 10/1990 Tissot et al. ..... 4/234
5,010,601 A * 4/1991 Kobayashi et al. ..... 4/236
5,933,875 A * 8/1999 Hulsebus et al. ..... 4/240
6,026,520 A * 2/2000 Pedersen ..... 4/236
6,070,295 A 6/2000 Hulsebus
6,931,672 B1 * 8/2005 Richter ..... 4/240
7,827,626 B2 * 11/2010 Zhou ..... 4/236
8,087,103 B2 * 1/2012 Leibfried ..... 4/234
8,118,526 B2 * 2/2012 Dowling ..... 411/82
2005/0217009 A1 * 10/2005 Vierkant et al. ..... 4/240
2006/0156458 A1 * 7/2006 Myers ..... 4/234
2007/0250996 A1 * 11/2007 Li ..... 4/236
2008/0209620 A1 * 9/2008 Hand et al. ..... 4/314

* cited by examiner

*Primary Examiner* — Lori Baker
(74) *Attorney, Agent, or Firm* — Law Offices of S. J. Christine Yang

(57) ABSTRACT

A device for affixing a toilet seat to a toilet bowl includes a fixing component having a through-hole and removably coupling to a fixing member, a hinge base receiving the fixing component, a hinge cover, the hinge cover being rotatable when covering a portion of the hinge base and having a locked position, and a rib on an internal surface of the hinge cover, the rib including an inward projection for engaging an indentation of the fixing component when the hinge cover is in a locked position. The hinge cover of another device can slide onto the hinge base into a locked position. The device can quickly install the toilet seat and provide quick release of the toilet seat.

21 Claims, 9 Drawing Sheets

200

202

HINGE ASSEMBLY FOR TOILET SEAT

BACKGROUND OF THE INVENTION

1. Field of the Invention

The present invention relates to an affixing assembly, and more particularly, to a hinge assembly. Although embodiments of the invention is suitable for a wide scope of applications, it is particularly suitable for enabling easy installation and quick release of a toilet seat from a toilet bowl and for replacing a toilet seat without undoing mounting screw or bolts from the toilet bowl.

2. Discussion of the Related Art

A toilet seat generally requires more frequent replacement than a toilet bowl due to wear and tear, and a toilet seat can be replaced without replacing the entire toilet. A toilet seat also can be replaced to match any bathroom color scheme or motif.

In general, a toilet seat is affixed to a toilet bowl by placing mounting screws or bolts through a flange portion of the toilet bowl and by fastening screw nuts from the bottom surface of the toilet bowl to the mounting screws. Conventionally, to replace the toilet seat, each of the screws or mounting bolts needs to be unfastened from the washers and nuts.

FIG. 1 is a perspective diagram illustrating a toilet according to the related art. In FIG. 1, a toilet seat 1 is provided with two mounting bolts 2, and a toilet bowl 3 has a flange portion with two through-holes 4. To secure the toilet seat 1 onto the toilet bowl 3, the mounting bolts 2, which are first coupled to the toilet seat 1, are inserted through the through-holes 4 of the toilet bowl 3. Nuts 5 and washers 6 then are threaded onto the mounting bolts 2 from the bottom side of the toilet bowl 3. The toilet seat 1 is thereby affixed to the toilet bowl 3 by the fastening of the mounting bolts 2 and the nuts 5 together.

To remove the toilet seat 1 from the toilet bowl 3, the nuts 5 need to be loosened and unfastened from the mounting bolts 2. However, as mounting screws and bolts rust or corrode especially in a moist environment, the screws or the mounting bolts can be hard to loosen or unfasten. Furthermore, the nuts can recess due to the passage of time, making the nuts practically inaccessible and toilet seat replacement difficult.

SUMMARY OF THE INVENTION

Accordingly, embodiments of the invention are directed to an affixing assembly that substantially obviates one or more of the problems due to limitations and disadvantages of the related art.

An object of embodiments of the invention is to provide a hinge assembly that provides easy installation and quick release of a toilet seat, and yet is inexpensive to manufacture.

Another object of embodiments of the invention is to provide a hinge assembly that provides easy replacement of a toilet seat despite any rusted, corroded or deformed mounting bolts or nuts.

Yet, another object of embodiments of the invention is to provide a hinge assembly that provides replacement of a toilet seat without necessarily replacing mounting bolts or nuts.

Another object of embodiments of the invention is to provide a hinge assembly that prevents movement of mounting bolts with a rotatable cover.

Another object of embodiments of the invention is to provide a hinge assembly that prevents movement of mounting bolts with a sliding cover.

Additional features and advantages of embodiments of the invention will be set forth in the description which follows, and in part will be apparent from the description, or may be learned by practice of embodiments of the invention. The objectives and other advantages of the embodiments of the invention will be realized and attained by the structure particularly pointed out in the written description and claims hereof as well as the appended drawings.

To achieve these and other advantages and in accordance with the purpose of embodiments of the invention, as embodied and broadly described, a device for affixing a toilet seat to a toilet bowl includes a fixing component having a through-hole and removably coupling to a fixing member, a hinge base receiving the fixing component, a hinge cover, the hinge cover being rotatable when covering a portion of the hinge base and having a locked position, and a rib on an internal surface of the hinge cover, the rib including an inward projection for engaging an indentation of the fixing component when the hinge cover is in a locked position.

In another aspect, a device for affixing a toilet seat to a toilet bowl includes a fixing component having a through-hole and removably coupling to a fixing member, a hinge base receiving the fixing component, a hinge cover, the hinge cover being slidable on the hinge base to a locked position, and a rib on an internal surface of the hinge cover, the rib engaging an indentation of the fixing component when the hinge cover is in a locked position.

In another aspect, an affixing device includes a fixing component having a through-hole and removably coupling to a fixing member, a fixing base receiving the fixing component, a base cover, the base cover being removable from the fixing base, selectively covering a portion of the fixing base and having a locked position, and a rib formed on an internal surface of the base cover, the rib including an inward projection for engaging an indentation of the fixing component when the hinge cover is in a locked position.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of embodiments of the invention and are incorporated in and constitute a part of this specification, illustrate embodiments of the invention and together with the description serve to explain the principles of embodiments of the invention.

DETAILED DESCRIPTION OF THE PREFERRED EMBODIMENTS

Reference will now be made in detail to the preferred embodiments of the invention, examples of which are illustrated in the accompanying drawings.

Figure 1:
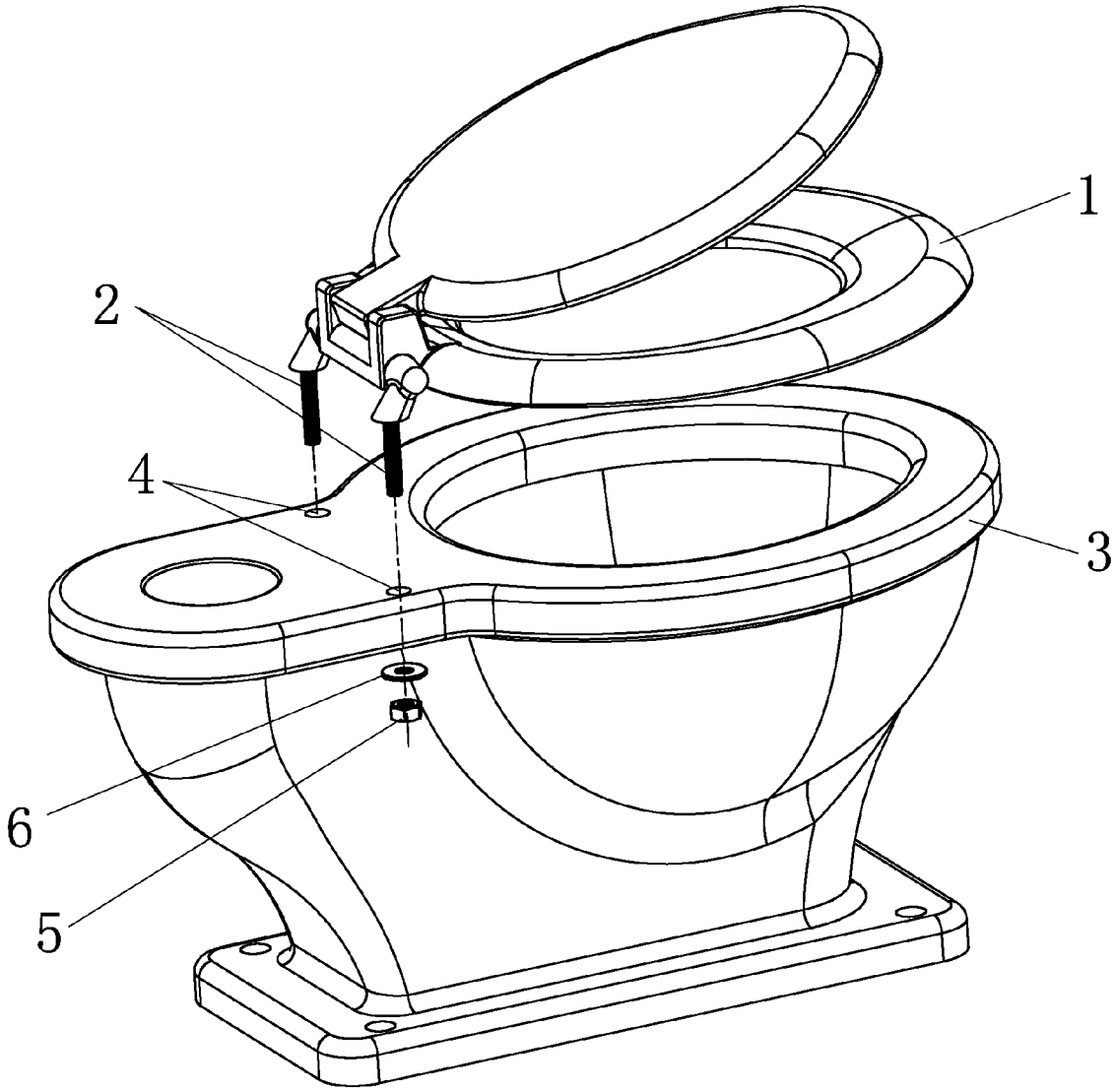
FIG. 1 RELATED ART
FIG. 1 is a perspective diagram illustrating a toilet according to the related art.
Figure 2A:
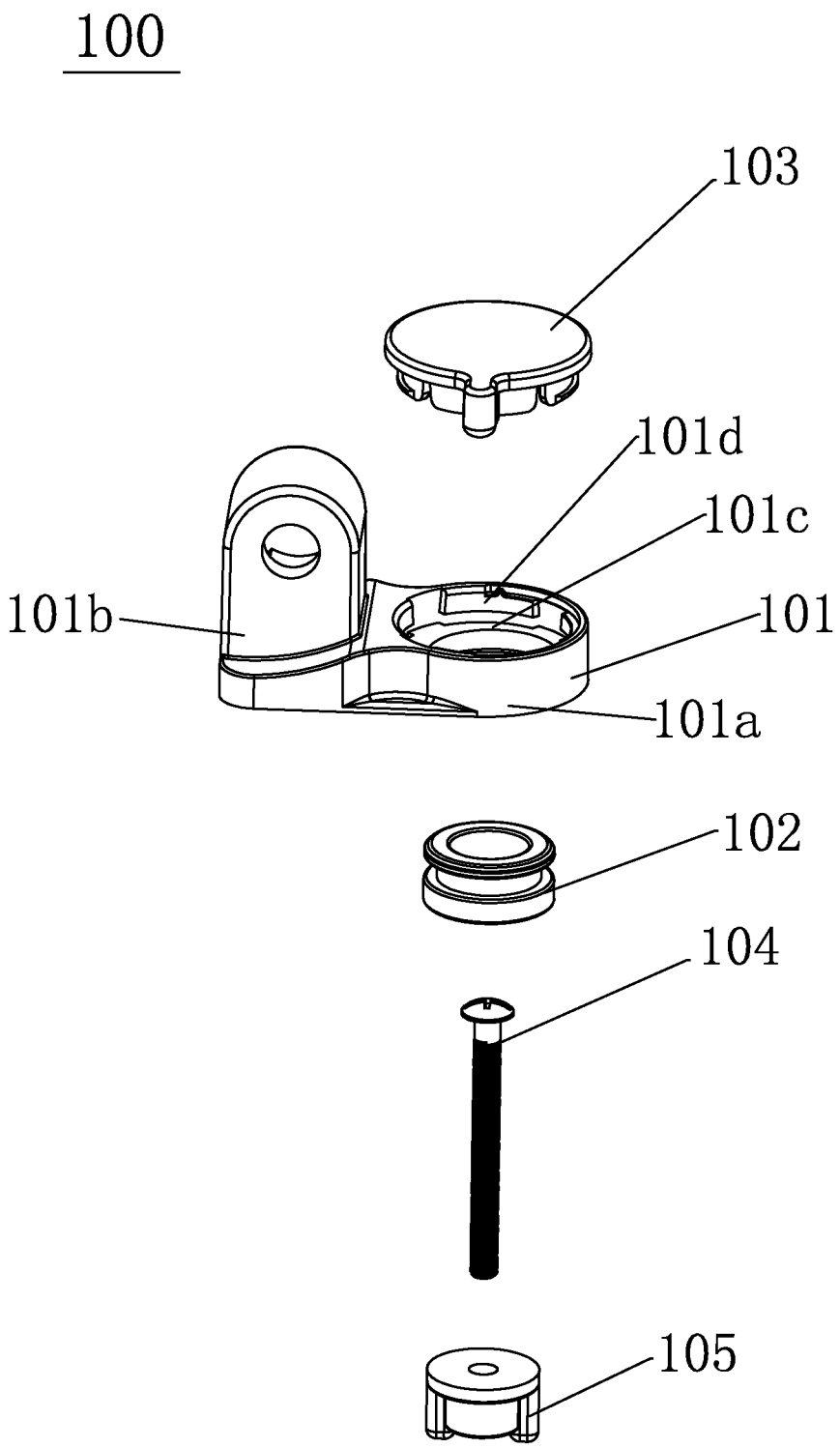
FIG. 2A is an exploded view illustrating a hinge assembly according to an embodiment of the present invention.

FIG. 2A is an exploded view illustrating a hinge assembly according to an embodiment of the present invention. In FIG. 2A, a hinge assembly 100 includes a hinge base 101, a fixing cap 102 and a hinge cover 103. The hinge base 101 includes a bottom extension 101*a* and a vertically post 101*b*. A through-hole 101*c* is in the bottom extension 101*a* for receiving the fixing cap 102. The through-hole 101*c* may be larger in size than the fixing cap 102 and the fixing cap 102 may have a ring-like shape, a generally circular opening or a shape complementary to receive a mounting screw or bolt 104. For example, the fixing cap 102 could move freely in or out of the through-hole 101*c* until the hinge cover 103 engages the fixing cap 102 in a locked position.

Figure 3A:
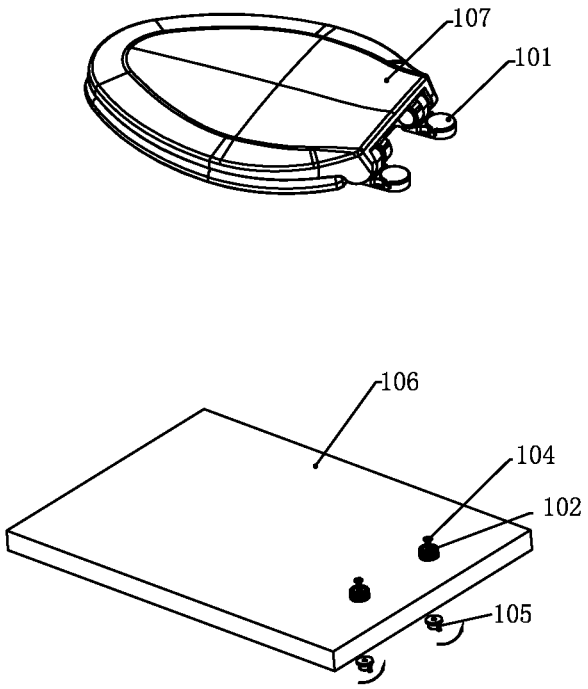
FIGS. 3A-3C are perspective views illustrating steps of securing a toilet seat to a toilet bowl using a hinge assembly according to an embodiment of the present invention.

The mounting screw or bolt 104 is to first pass through the fixing cap 102 and then through a fixture, such as a flange portion of a toilet bowl (shown in FIG. 3A). Thereafter, the mounting screw 104 is fastened to the fixture, along with the fixing cap 102, with a screw or bolt nut 105.

Figure 2B:
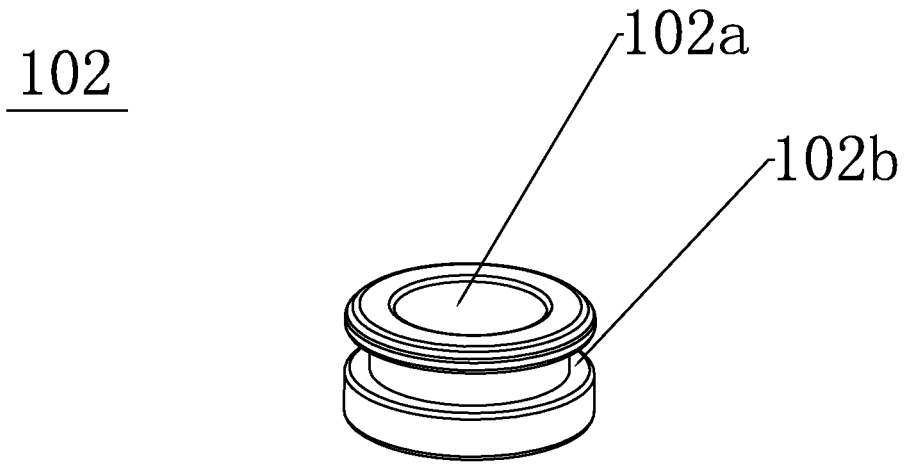
FIG. 2B is a detailed perspective view illustrating the fixing cap shown in FIG. 2A.

FIG. 2B is a detailed perspective view illustrating the fixing cap shown in FIG. 2A. As shown in FIG. 2B, the fixing cap 102 has a cavity 102*a* in its center and indentation 102*b* on its outer surface. The cavity 102*a* may be circular and include a through-hole at its bottom surface. The indentation 102*b* may be along an entire outer-side circumference of the fixing cap 102.

Figure 2C:
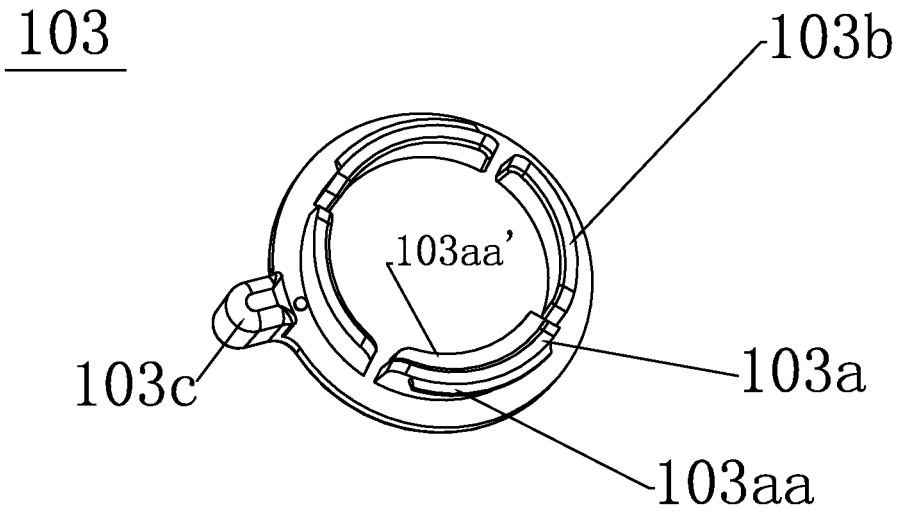
FIG. 2C is a detailed perspective view illustrating the hinge cover shown in FIG. 2A.

FIG. 2C is a detailed perspective view illustrating the hinge cover shown in FIG. 2A. As shown in FIG. 2C, the hinge cover 103 has first and second ribs 103*a* and 103*b* on its bottom surface and a tab 103*c* along its edge. The first rib 103*a* includes an outward projection 103*aa* on its outer surface, and the second rib 103*b* has a generally smooth outer surface. The outward projection 103*aa* engages with a projection 101*d* of the hinge base 101, when the hinge cover 103 is in the locked position.

In addition, one of the first and second ribs 103*a* and 103*b* includes an inward projection 103*aa*' on its internal surface. The inward projection 103*aa*' engages with the indentation 102*b* of the fixing cap 102, when the hinge cover 103 in the locked position.

FIG. 2C shows two of the first ribs 103*a* and two of the second ribs 103*b* alternatively arranged along the circumference of the bottom surface of the hinge cover 103. However, the first and second ribs 103*a* and 103*b* may be arranged in any manner, and the hinge cover 103 may include one or more of each of the first and second ribs 103*a* and 103*b*. Further, the inward projection 103*aa*' may preferably be formed on an internal surface of the first rib 103*a*.

The hinge cover 103 can cover the hinge base 101 by pressing the hinge cover 103 into the hinge base 101. Further, when the hinge cover 103 covers the hinge base 101, the hinge cover 103 is rotatable. The tab 103*c* facilitates an easy rotation of the hinge cover 103. As the hinge cover 103 rotates, the hinge cover 103 comes to the locked position. As the hinge cover 103 rotates, the inward projection 103*aa*' aligns and overlaps at least a portion of the indentation of the fixing cap 102. Thus, in the locked position, the inward projection 103*aa*' engages with the indentation 102*b* of the fixing cap 102. As a result, when the hinge cover 103 is in the locked position, the hinge cover 103 engages the fixing cap 102 at its bottom surface and prevents movement of the fixing cap 102.

Figure 3B:
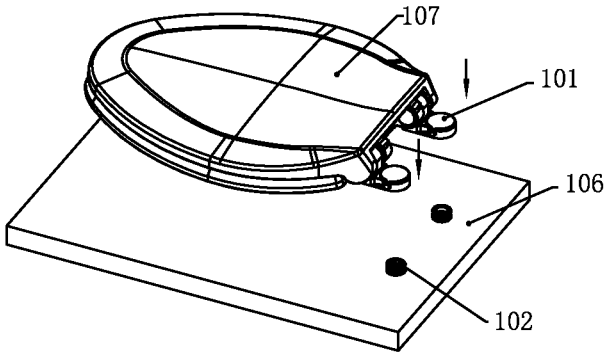
Figure 3C:
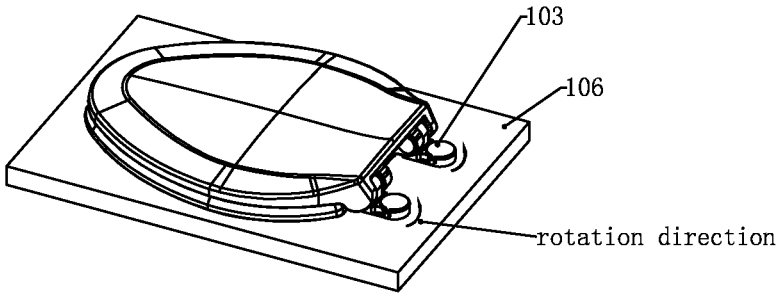

FIGS. 3A-3C are perspective views illustrating steps of securing a toilet seat to a toilet bowl using a hinge assembly according to an embodiment of the present invention. In FIG. 3A, the mounting screw 104 is fastened to a toilet bowl 106 (illustrated as a planar ceramic pan in FIGS. 3A-3C), along with the fixing cap 102, with the screw nut 105. For example, the fixing cap 102 may first be aligned with through-holes provided in the toilet bowl 106. The mounting screw 104 may then pass through the fixing cap 102 and the through-holes in the toilet bowl 106. Thereafter, the screw nut 105 may be screwed on the thread of the mounting screw 104 from the bottom surface of the toilet bowl 106. The mounting screw 104 is then fastened to the toilet bowl 106, along with the fixing cap 102 and the screw nut 105. A washer (not shown) may be employed along with the screw nut 105.

As shown in FIG. 3A, a toilet seat 107 is attached to the hinge base 101. For example, the toilet seat 107 may be attached to the vertically post 101*b* of the hinge base 101 (shown in more details in FIG. 2A). In particular, the attachment of the toilet seat 107 to the hinge base 101 may be separately prepared from the fastening of the mounting screw 104 to the toilet bowl 106.

In FIG. 3B, the toilet seat 107 with the hinge base 101 already attached thereto is placed over the toilet bowl 106. More specifically, the hinge base 101 is to receive the fixing cap 102 in the cavity 101*c* (shown in FIG. 2A).

As shown in FIG. 3C, the hinge cover 103 is then placed over the bottom extension 101*a* of the hinge base 101 by pressing the hinge cover 103 into the hinge base 101. The hinge cover 103 can then be rotated into the locked position, such that even when a user attempt to lift up the hinge cover 103, the hinge cover 103 could not be lifted away from the hinge base 101. Alternatively, the hinge cover 103 may be placed over the hinge base 101 prior to the toilet seat 107 being placed over the toilet bowl 106. Then, the hinge cover 103 is rotated into the locked position only after the hinge base 101 receives the fixing cap 102.

Figure 4:
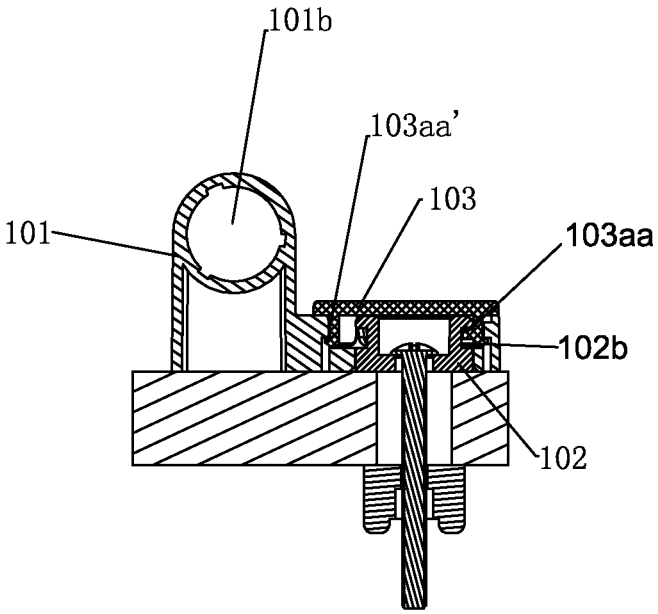
FIG. 4 is a side view of the hinge assembly with the hinge cover being in a locked position according to an embodiment of the present invention.

FIG. 4 is a side view of the hinge assembly with the hinge cover being in the locked position according to an embodiment of the present invention. As shown in FIG. 4, the hinge assembly includes the hinge base 101, the fixing cap 102 and the hinge cover 103. The hinge base 101, the fixing cap 102 and the hinge cover 103 may be formed of plastic. In addition, the first and second ribs 103*a* and 103*b* are arranged on the bottom surface of the hinge cover 103. When the hinge cover 103 is in the locked position, the outward projection 103*aa* engages with a projection 101*d* of the hinge base 101. Further, when the hinge cover 103 is in the locked position, the inward projection 103*aa*' engages with the indentation 102*b* of the fixing cap 102. The ribs 103*a* and 103*b* therefore engage the fixing cap 102 and prevent movement of the fixing cap 102. The toilet seat (not shown) is thereby affixed to the toilet bowl 106. The toilet seat (not shown) can be attached to the hinge assembly at the vertical post 101*b* and can pivot about the vertical post 101*b*.

As a result, the hinge assembly according to an embodiment of the present invention easily installs a toilet seat and allows quick release of the toilet seat. In addition, the toilet seat can be replaced without loosening the mounting screw from the toilet bowl. Thus, maintenance and repair of a toilet seat according to an embodiment of the present invention is improved.

Figure 5A:
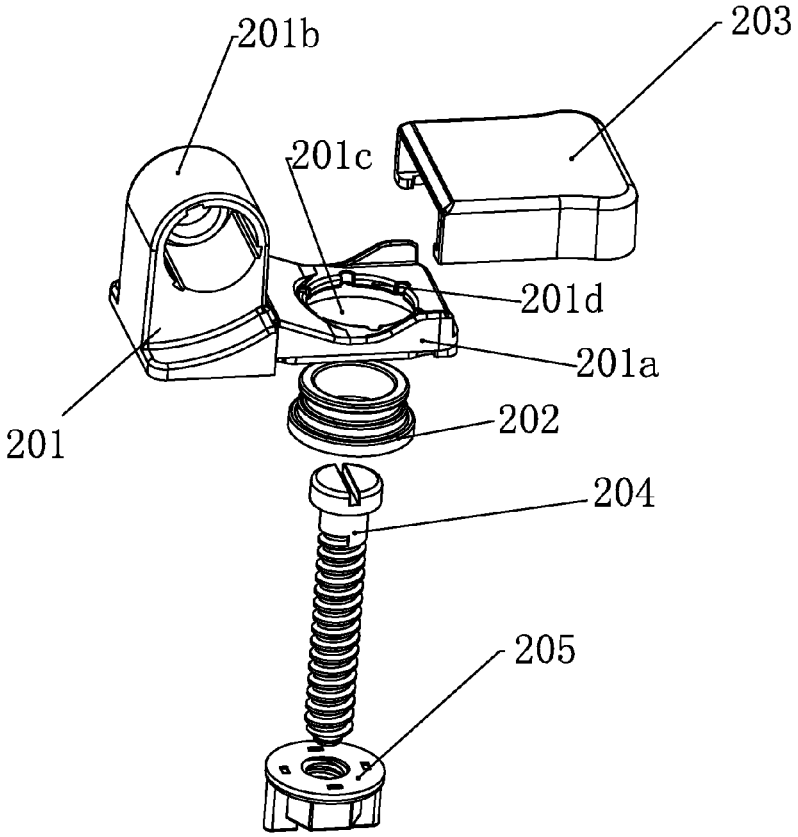
FIG. 5A is an exploded view illustrating a hinge assembly according to another embodiment of the present invention.

FIG. 5A is an exploded view illustrating a hinge assembly according to another embodiment of the present invention. In FIG. 5A, a hinge assembly 200 includes a hinge base 201, a fixing cap 202 and a hinge cover 203. The hinge base 201 includes a bottom extension 201*a* and a vertically post 201*b*. A though-hole 201*c* is in the bottom extension 201*a* for receiving the fixing cap 202. Inward projections 201*d* are formed along the edge of the through-hole 201*c*.

Figure 6A:
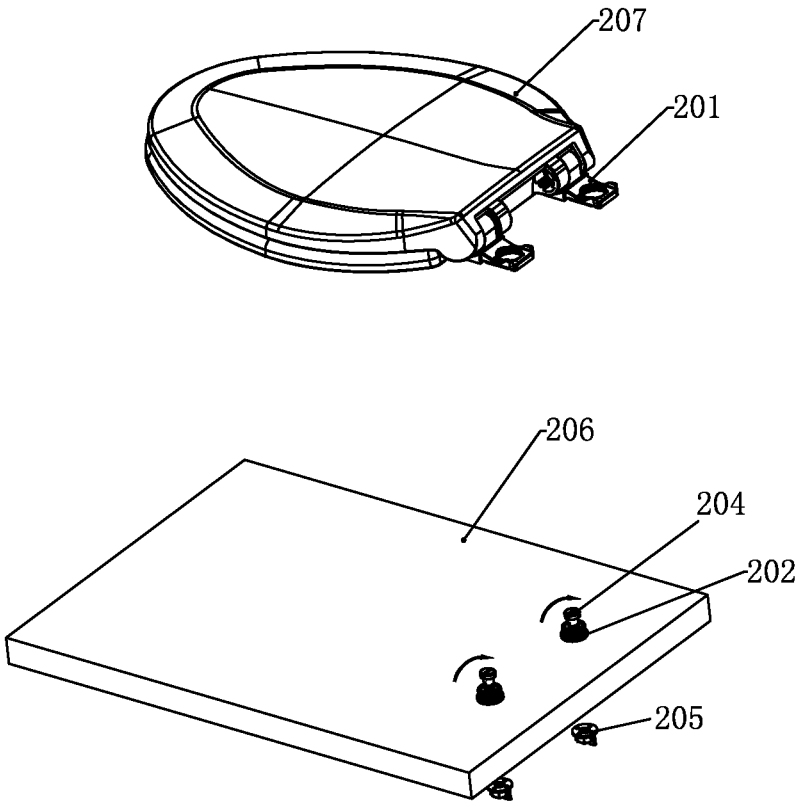
FIGS. 6A-6C are perspective views illustrating steps of securing a toilet seat to a toilet bowl using a hinge assembly according to an embodiment of the present invention.

A mounting screw or bolt 204 is to first pass through the fixing cap 202 and then through a fixture, such as a flange portion of a toilet bowl (shown in FIG. 6A). Thereafter, the mounting screw 204 is fastened to the fixture, along with the fixing cap 202, with a screw or bolt nut 205.

Figure 5B:
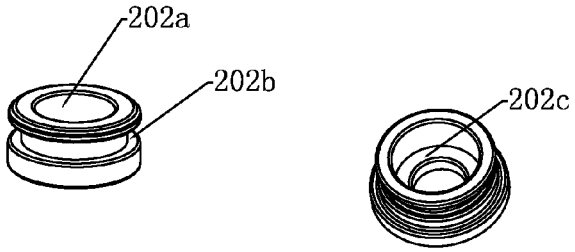
FIG. 5B is a detailed perspective view illustrating the fixing cap shown in FIG. 5A.

FIG. 5B is a detailed perspective view illustrating the fixing cap shown in FIG. 5A. As shown in FIG. 5B, the fixing cap 202 has a cavity 202*a* in its center and indentation 202*b* on its outer surface. The cavity 102*a* may be circular and include a through-hole at its bottom surface. The indentation 202*b* may be along an entire outer-side circumference of the fixing cap 202. The fixing cap 202 may be wider at its base. For example, when the fixing cap 202 is received in the cavity 201*c* of the hinge base 201, an upper portion of the fixing cap 202 enters into the cavity 201*c* and the wider base of the fixing cap 202 abuts against the projections 201*d*. As a result, the vertical movement of the fixing cap 202 is prevented, when the fixing cap 202 is received by the hinge base 201.

Figure 5C:
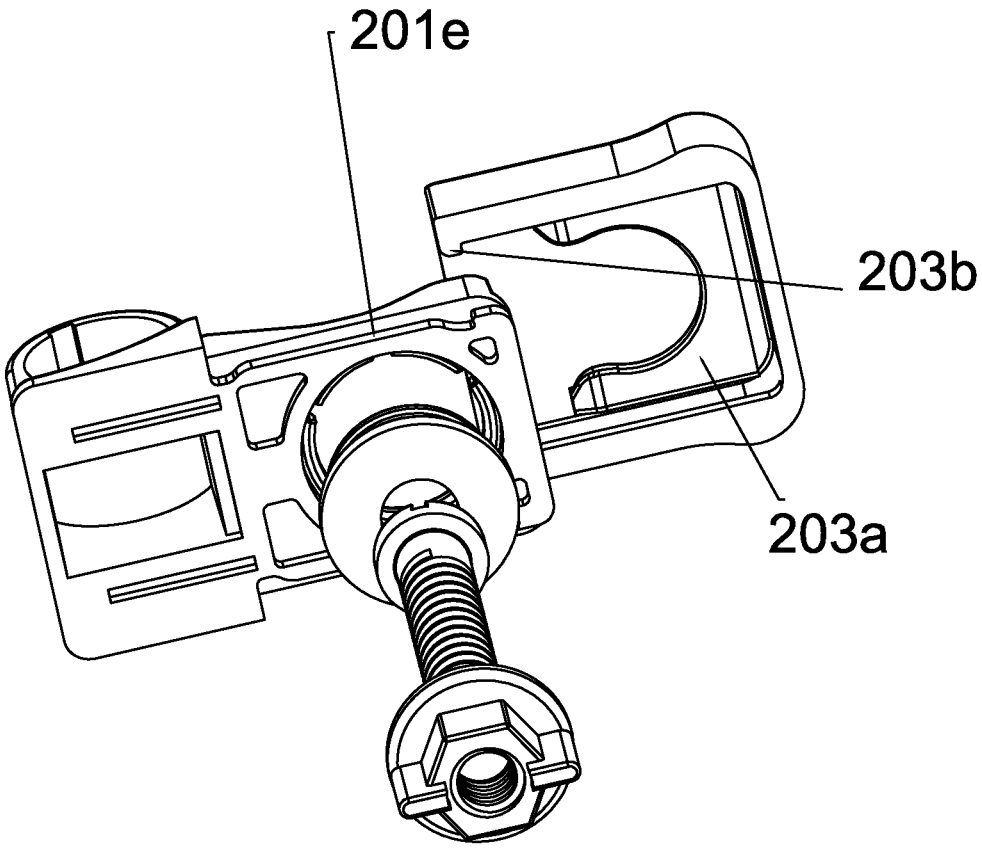
FIG. 5C is another perspective view illustrating the hinge assembly shown in FIG. 5A.

FIG. 5C is another perspective view illustrating the hinge assembly shown in FIG. 5A. As shown in FIG. 5C, the hinge cover 203 has a rib 203*a* on its bottom surface and guides 203*b* along its longitudinal edges. The rib 203*a* may have a "U"-like opening. The rib 203*a* engages with the indentation 202*b* as the hinge cover 203 slides onto the hinge base 201. The hinge cover 203 may slide onto the hinge base 201 along the guides 203*b*.

In addition, the hinge base 201 may have recess 201*e* along portions of the longitudinal edges of the bottom extension 201*a*. The recess 201*e* can engage the guides 203*b* as the hinge cover 203 slides onto the hinge base 201. As the hinge cover 203 slides onto the hinge base 201, the hinge cover 203 eventually abuts against the vertical post 201*b* and come to a locked position. Thus, in the locked position, the rib 203*a* engages with the indentation 202*b* of the fixing cap 202. As a result, when the hinge cover 203 is in the locked position, the hinge cover 203 engages the fixing cap 202 at its bottom surface and prevents movement of the fixing cap 202. Furthermore, vertical and horizontal movements of the fixing cap 202 are further prevented by the projections along the cavity 201*c* of the hinge base 201.

FIGS. 6A-6D are perspective views illustrating steps of securing a toilet seat to a toilet bowl using a hinge assembly according to an embodiment of the present invention. In FIG. 6A, the mounting screw 204 is fastened to a toilet bowl 206 (illustrated as a planar ceramic pan in FIGS. 6A-6C), along with the fixing cap 202, with the screw nut 205. For example, the fixing cap 202 may first be aligned with through-holes provided in the toilet bowl 206. The mounting screw 204 may then pass through the fixing cap 202 and the through-holes in the toilet bowl 206. Thereafter, the screw nut 205 may be screwed on the thread of the mounting screw 204 from the bottom surface of the toilet bowl 206. The mounting screw 204 is then fastened to the toilet bowl 206, along with the fixing cap 202 and the screw nut 205. A washer (not shown) may be employed along with the screw nut 205.

As shown in FIG. 6A, a toilet seat 207 is attached to the hinge base 201. For example, the toilet seat 207 may be attached to the vertically post 201*b* of the hinge base 201 (shown in more details in FIG. 5A). In particular, the attachment of the toilet seat 207 to the hinge base 201 may be separately prepared from the fastening of the mounting screw 204 to the toilet bowl 206.

Figure 6B:
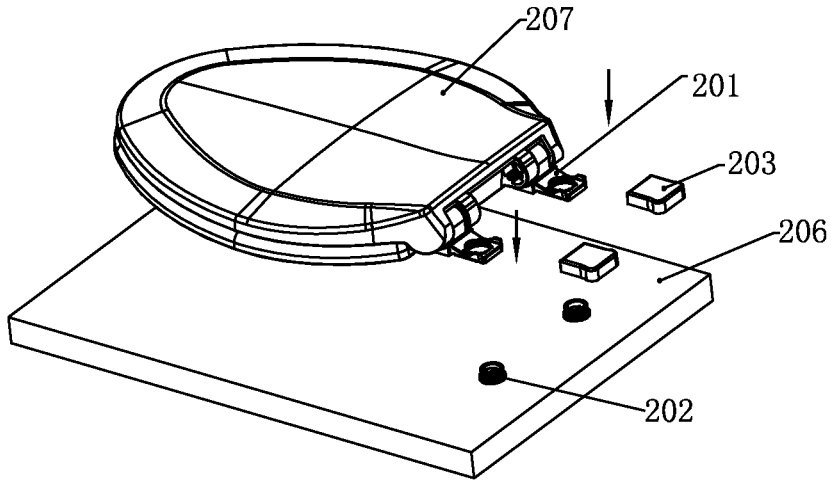

In FIG. 6B, the toilet seat 207 with the hinge base 201 already attached thereto is placed over the toilet bowl 206. More specifically, the hinge base 201 is to receive the fixing cap 202 in the cavity 201*c* (shown in FIG. 5A).

Figure 6C:
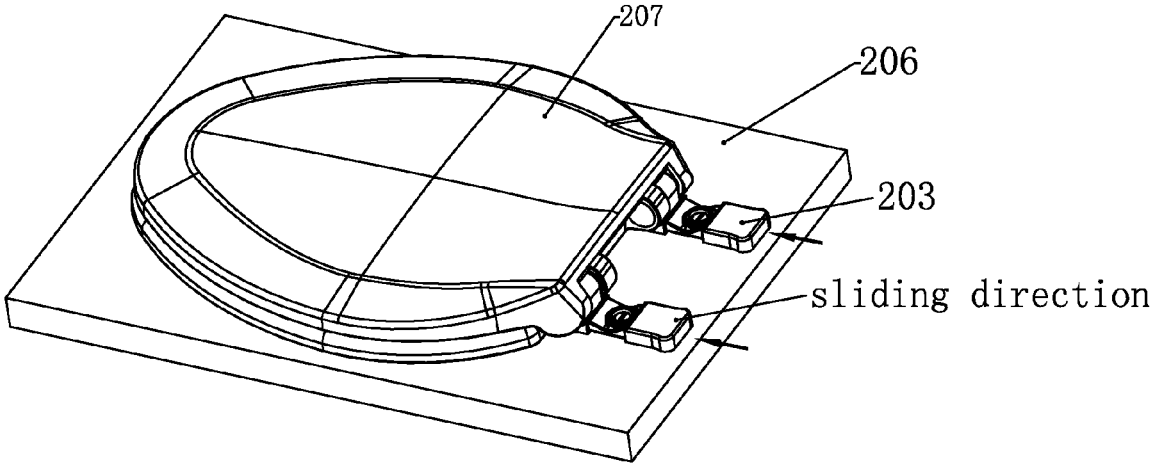

As shown in FIG. 6C, the hinge cover 203 then slides onto the bottom extension 201*a* of the hinge base 201 and eventually abuts against the vertical post 201*b* of the hinge base 201.

As a result, the hinge assembly according to an embodiment of the present invention easily installs a toilet seat and allows quick release of the toilet seat. In addition, the toilet seat can be replaced without loosening the mounting screw from the toilet bowl. Thus, maintenance and repair of a toilet seat according to an embodiment of the present invention is improved.

Although a plastic hinge assembly is described above, the hinge assembly according to an embodiment of the present invention may be formed of another suitable material. Further, although not shown, the hinge base according to an embodiment of the present invention may include additional cavities for reducing material use, thereby reducing manufacturing cost.

In addition, although the hinge assembly is described above to attach to the affixing object (such as a toilet seat) at a vertical post, the hinge assembly according to an embodiment of the present invention may be attached to the affixing object in another manner. Furthermore, although the hinge assembly is described above for affixing a toilet seat to a toilet bowl, the hinge assembly according to an embodiment of the present invention may be employed to affix any object to through-holes.

The hinge assembly according to an embodiment of the present invention provides easy installation of a toilet seat. The toilet seat can be aligned and placed over mounting bolts and nuts that have separately attached to the toilet bowl first.

The hinge assembly according to an embodiment of the present invention also enables quick release of a toilet seat. The toilet seat can be removed without unfastening or undoing mounting bolts and nuts that are attached to the toilet bowl.

It will be apparent to those skilled in the art that various modifications and variations can be made in the hinge assembly of embodiments of the invention without departing from the spirit or scope of the invention. Thus, it is intended that embodiments of the invention cover the modifications and variations of this invention provided they come within the scope of the appended claims and their equivalents.

What is claimed:

1. A device for affixing a toilet seat to a toilet bowl, comprising:

a fixing component having a first through-hole and removably coupling to a fixing member;

a hinge base having a second through-hole in a lower surface and a cavity above the second through-hole, wherein the hinge base receives the fixing component through the second through-hole and a first portion of the fixing component protrudes above the second through-hole and into the hinge base cavity;

a hinge cover, the hinge cover being rotatable when covering a portion of the hinge base and having a locked position; and a rib on an internal surface of the hinge cover, the rib including an inward projection for engaging an indentation on an exterior side surface of the first portion of the fixing component and including an outward projection for engaging a projection on an internal surface of the hinge base cavity only when the hinge cover is in the locked position.

2. The device according to claim 1, wherein the fixing component is vertically movable in the second through-hole and in the hinge base cavity until the hinge cover is rotated into the locked position.

3. The device according to claim 1, wherein the cavity is larger than the second through-hole in opening perimeter.

4. The device according to claim 1, wherein the fixing component has a ring shape.

5. The device according to claim 1, wherein the hinge base includes a post for selectively attaching to the toilet seat and wherein the toilet seat pivots above the post when the toilet seat is attached to the post.

6. A device for affixing a toilet seat to a toilet bowl, comprising:

a fixing component having a first through-hole and removably coupling to a fixing member;

a hinge base having a second through-hole and receiving the fixing component through the second through-hole;

a hinge cover, the hinge cover being slidable on the hinge base; and a rib along an internal upper surface of the hinge cover, the rib engaging an indentation on an exterior side surface of the fixing component when the hinge cover is slided onto the hinge base, wherein when the fixing component is received in the hinge base, a first portion of the fixing component protrudes above the second through-hole.

7. The device according to claim 6, further comprising:

guides on the internal surface of the hinge cover, the guides being along longitudinal edges of the hinge cover; and recess along portions of the longitudinal edges of the hinge base, wherein as the hinge cover slides onto the hinge base, the hinge cover guides engage with the recess of the hinge base.

8. The device according to claim 6, wherein the rib has a "U" shape.

9. The device according to claim 6, further comprising:

inward projections being along an edge of the second through-hole.

10. The device according to claim 9, wherein the fixing component further includes a base, the base being wider than the first portion, and wherein when the fixing component is received in the hinge base, the base of the fixing component abuts against the inward projections on the hinge base.

11. The device according to claim 6, wherein the fixing component has a ring shape.

12. The device according to claim 6, wherein the hinge base includes a post for selectively attaching to the toilet seat and wherein the toilet seat pivots above the post when the toilet seat is attached to the post.

13. An affixing device, comprising:

a circular fixing component having a through-hole and removably coupling to a fixing member;

a fixing base receiving the fixing component;

a cover, the cover being removable from the fixing base, selectively covering a portion of the fixing base and having a locked position; and a rib on an internal surface of the base cover, the rib including an inward projection for engaging an indentation on an exterior side surface of the fixing component when the cover is in the locked position.

14. The device according to the claim 13, wherein the cover comes into the locked position by sliding over the fixing base.

15. The device according to claim 13, wherein the cover rotates about the fixing base.

16. The device according to the claim 1, wherein the hinge base is movable independently from the hinge cover, the fixing component and the toilet bowl, until the hinge cover is rotated into the locked position.

17. The device according to the claim 14, wherein the rib is along an internal upper surface of the cover and has a U-opening.

18. The device according to claim 17, wherein the fixing base includes a second through-hole in its lower surface, and inward projections being along an edge of the second through-hole, wherein when the fixing base receives the circular fixing component through the second through-hole, the inward projections abut against a base portion of the fixing component.

19. The device according to the claim 15, wherein the fixing base includes a second through-hole in its lower surface and a cavity above the second through-hole, wherein the fixing base receives the circular fixing component through the second through-hole and a first portion of the fixing component protrudes above the second through-hole and into the fixing base cavity.

20. The device according to the claim 19, wherein the rib of the cover further includes an outward projection for engaging a projection on an internal surface of the fixing base cavity, only when the cover is rotated into the locked position.

21. The device according to the claim 15, wherein the fixing base is movable independently from the cover and the circular fixing component until the cover is rotated into the locked position.

* * * * *